United States Patent [19]

Maurer

[11] 4,287,956

[45] Sep. 8, 1981

[54] IMPACT WRENCH MECHANISM AND PIVOT CLUTCH

[76] Inventor: Spencer B. Maurer, 6070 Tarawood Dr., Orlando, Fla. 32811

[21] Appl. No.: 65,541

[22] Filed: Aug. 10, 1979

[51] Int. Cl.[3] ..... B25D 15/02

[52] U.S. Cl. ..... 173/93.5

[58] Field of Search ..... 173/93.5, 93, 93.6, 173/94, 93.7; 81/52.3

[56] References Cited

U.S. PATENT DOCUMENTS

| | | | |
|---|---|---|---|
| 2,261,204 | 11/1941 | Amtsberg | 173/93.6 X |
| 2,580,631 | 1/1952 | Whitledge | 173/93.5 |
| 2,600,495 | 6/1952 | Fitch | 173/93.5 |
| 2,886,997 | 5/1959 | Madsen | 173/93.5 |
| 3,072,232 | 1/1963 | Martin et al. | 173/93.5 |
| 3,144,108 | 8/1964 | Reynolds | 173/93.5 |
| 3,321,043 | 5/1967 | Vaughn | 173/93.5 |
| 3,533,479 | 10/1970 | Madsen | 173/93.5 |
| 3,552,499 | 1/1971 | Maurer | 173/93 |
| 3,557,884 | 1/1971 | Allen | 173/93.5 |
| 3,661,217 | 5/1972 | Maurer | 173/93.5 |

*Primary Examiner*—Werner H. Schroeder
*Assistant Examiner*—Andrew M. Falik
*Attorney, Agent, or Firm*—Eber J. Hyde

[57] ABSTRACT

This invention pertains to a rotary impact tool and a clutch therefor, wherein a motor drives a carrier cage or member within which is pivotally mounted one or more swinging hollow hammer members. An output shaft extends through the carrier member and through the hollow hammer member and includes forward and reverse impact anvil surfaces. The hammer member is, or members are, mounted to swing in respect to the carrier member as the hammer member(s) rotate(s) with the carrier member, and carries forward and reverse impact jaws on its internal surface. As the clutch is driven in the forward direction by an air motor or the like, the forward impact jaw is moved in and out of the path of the anvil jaw on the output shaft by cam action, and during an impact blow the inertia of the rotating hammer member(s) act automatically to hold the impact jaw in engagement with the anvil jaw.

13 Claims, 10 Drawing Figures

IMPACT WRENCH MECHANISM AND PIVOT CLUTCH

This invention comprises improvements on the rotary impact tool shown, described and claimed in U.S. Pat. No. 3,661,217, issued on May 9, 1972 to Spencer B. Maurer, on an application filed July 7, 1970, which was a continuation-in-part of Application Ser. No. 852,574, filed Aug. 25, 1969 abandoned.

The improvements comprise critical clearance between the hammer means and its pivot member means on which the hammer means swings, be it one or two hammers; definite limit stop means on the output shaft to stop the hammer means (one or two) before a given hammer means engages the pivot member means for the other hammer member means in the case of two hammers; and the use of a much less expensive split carrier member means compared to the single-piece cage member of U.S. Pat. No. 3,661,217, and with the split carrier member means and two hammers an inertia balance feature which assures substantially equal hammer blows which greatly extends the life of the tool by reducing and equalizing stress on the hammer pivot member means and on the anvils of the output shaft.

The aforesaid U.S. Pat. No. 3,661,217 shows and describes in detail, particularly in FIGS. 2 through 5, the sequence in operation from clutch impact, disengagement, the start of the cam engagement and the end of the cam engagement. While portions of the present tool differ in configuration from the previous tool, operation of the clutch is similar; FIG. 9 of the present disclosure being the equivalent of FIG. 2 of U.S. Pat. No. 3,661,217.

Conventional rotary impact wrench mechanisms are known as "swinging weight" mechanisms and are disclosed in U.S. Pat. Nos. 2,285,638, issued to L. A. Amtsberg; 2,580,631, issued to E. R. Whitledge; and 2,600,495, issued to Fitch. These mechanisms, particularly Amtsberg, use a pair of diametrically opposed tilting hammer dogs or members which rotate around a lobed anvil and are cammed into an impact position with the lobes or jaws on the anvil by engagement with the anvil. The hammer dogs are relesed by the cams on the anvil immediately before impact and means is provided for applying a drive torque to the dogs to cause them to rotate to a disengaging position following an impact.

The version of "swinging weight" type of mechanism shown in the foregoing Amtsberg patent is believed to have certain disadvantages and one of these is that it often rebounds after impact and strikes a second blow before disengaging the hammer from the anvil for continued rotation. Also, this mechanism and the others are believed to be inefficient in delivering its blow energy to the anvil because a portion of such energy is used to disengage the hammer member, causing such member to tilt toward disengaging position during the impact. The version of the "swinging weight" type of mechanism is shown in the U.S. Pat. No. 2,580,631 to E. R. Whitledge, wherein an anvil which carries a pair of axially and diametrically spaced lobes or jaws and a pair of axially spaced hammer members are pivoted in a hammer carrier on diametrically located pins with each hammer member being extended around the anvil. It is believed that this version also has problems of striking a second blow following impact and of using a part of the impact energy to cam the hammer member into disengaging position. In addition, in this later version, due to the location of the impact surface in the hammer member following or lagging its pivot, the impact creates tensional stresses in the hammer member which are less desirable than compressive stresses.

The principal object of this invention is to provide a novel impact mechanism which either eliminates or substantially minimizes the foregoing problems and is a more efficient, longer lasting and less expensive impact mechanism.

Another object of this invention is to provide an impact tool and clutch combination which results in a low cost, efficient, durable tool which is light in weight, powerful in its impacting action, and which has good run-down characteristics and which, in the two-hammer version, the hammers strike substantially equal blows.

A further object of the invention is to provide an impact clutch with a split cage or carrier member, the movable parts of which are easily and inexpensively formed, resulting in a low cost, reliable, and durable impact tool.

Another object of the invention is to provide an impact tool with a driving motor and clutch which is capable of efficient operation at both low and high output torques, and in which there is substantially an inertia balance for two-hammer operation which extends the life of the tool.

Further important objects include the following: to provide a "swinging weight" impact wrench mechanism having a hammer member means which is substantially free of tensional stresses during impact; to provide a "swinging weight" impact wrench mechanism having a swinging hammer member means pivoted on a type of pivot means which causes the limit stop means for the hammer member means to be on the output shaft instead of at least partially on the pivot member means; to provide a multi-part "swinging weight" mechanism of less expensive split frame construction which prevents the hammer from tilting toward a disengaged position during impact and which automatically tilts to its disengaged position during rebound following impact; to provide a "swinging weight" mechanism that is held by centrifugal force in anvil engaging position prior to impact; to provide a "swinging weight" mechanism having the center of mass of the hammer near the center of rotation of the mechanism; and to provide a two-hammer, split frame "swinging weight" mechanism that strikes balanced blows to the anvil.

An aspect of the present tool lies in the provision of a rotary impact tool having a housing within which a motor having a rotor is mounted. The output shaft of the tool is mounted on the housing for rotation and it includes impact receiving anvil jaw means generally radially disposed on its periphery. A hollow cage or carrier member means is coaxially around the output shaft and is mounted for rotation in respect to the tool output shaft. A rigid driving connection exists between the rotor and the carrier member so that the carrier member means rotates with the rotor. Hammer member means is pivotally connected in the carrier member means for rotation therewith as the motor rotor drives the carrier member means and for angular pivotal motion relative to the carrier member means about an axis offset from but parallel to the axis of rotation of the carrier member means. The hammer member means has impact delivering jaw means on its inside surface located between the axes and positioned to always lead its pivotal connection. The impact jaw means is movable into and out of the path of the impact receiving anvil means to deliver impact blows thereto. Cam means cause the angular movement of the impact delivering jaw means into the path of the anvil jaw means where it is held by centrifugal force until impact, and the inertia of the rotating hammer member means acts to prevent the disengagement during the impact blows. Automatic means cause angular movement of the impact jaw means out of the path of the anvil jaw means at the end of the impact blows. The carrier member means can contain two hammers for simultaneously striking a pair of anvil jaws to deliver a balanced impact torque to the output shaft.

Aspects of the present invention comprise improvements over the disclosure of U.S. Pat. No. 3,661,217 as follows: improved pivot action between the carrier member means and the hammer or hammers to establish clearance at the pivot area and to establish two accurately located, spaced "points" of engagement between a hammer means and the portion of the carrier member means about which it pivots: a two-hammer construction wherein substantial inertia balance of motor and clutch parts results in substantially equal hammer blows, and the pivot portion of the carrier member means for each hammer is not the stop for the other hammer.

For a better understanding of the present invention, together with other and further objects thereof, reference is had to the following description taken in connection with the accompanying drawings, and its scope will be pointed out in the appended claims.

Figure 1:
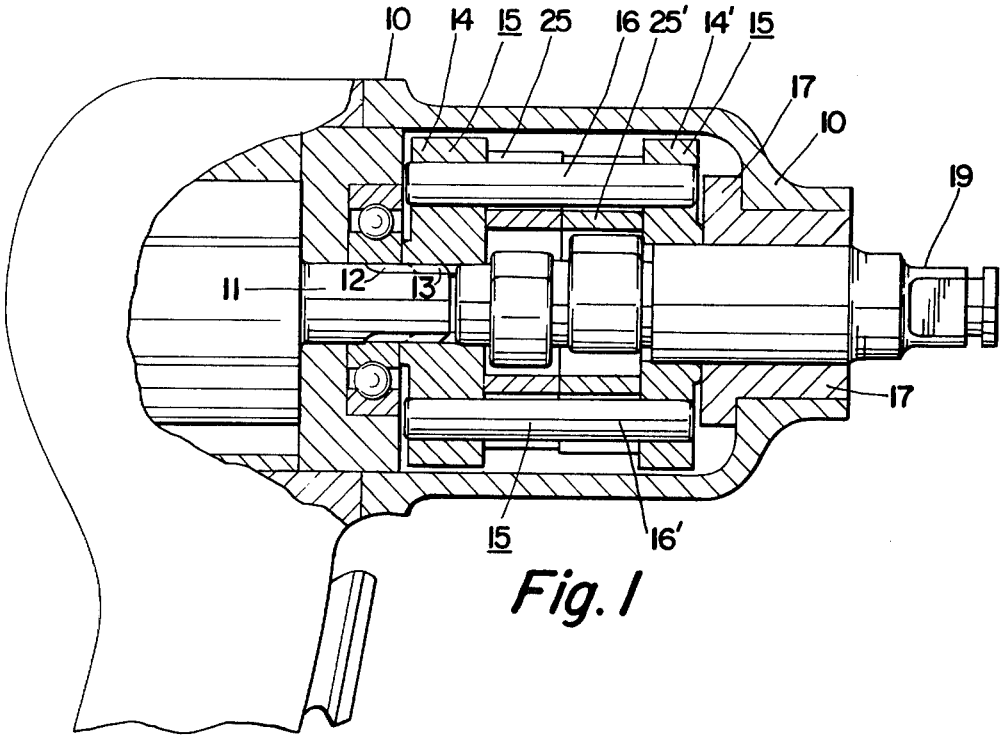
FIG. 1 is a side view of an impact tool showing a portion of the motor and the clutch portion in longitudinal section.

With reference to the drawings, FIG. 1 shows the tool in longitudinal section, with reference character 10 identifying the housing for the air driven impact wrench, the motor of which is well known in the art.

The output shaft 11 of the air motor is coupled through meshing splines 12,13 to a hollow cage or carrier member means 15 which is journaled by sleeve bearing 17 on the tool power output shaft 19. The motor shaft 11 is coaxially aligned with the power output shaft 19 and the carrier member means 15 is coaxially mounted around the output shaft 19, and is mounted for rotation in respect to the output shaft 19. The carrier member means 15 comprises a driver member 14 and a front end plate 14' spaced longitudinally apart and connected together by pins 16,16'. Thus the carrier member means 15 comprises the driver member 14, the front end plate 14', and connecting pins 16,16' extending through holes 18 in the driver member 14 and holes 18' in the front end plate 14'; thus the carrier member means may be referred to as a "split" carrier member contrasted to the much more expensive integral or "one-piece" carrier shown in U.S. Pat. No. 3,661,217.

The tool illustrated in FIG. 1 has two hammer member means 25,25' for balanced operation, but it is also contemplated that single hammer operation is feasible. It is also contemplated that for two-hammer operation an intermediate plate (not shown) may separate the two hammers with pins 16, 16' extending through holes therein to stiffen the carrier member means, but this would increase the cost and the length of the tool.

Figure 9:
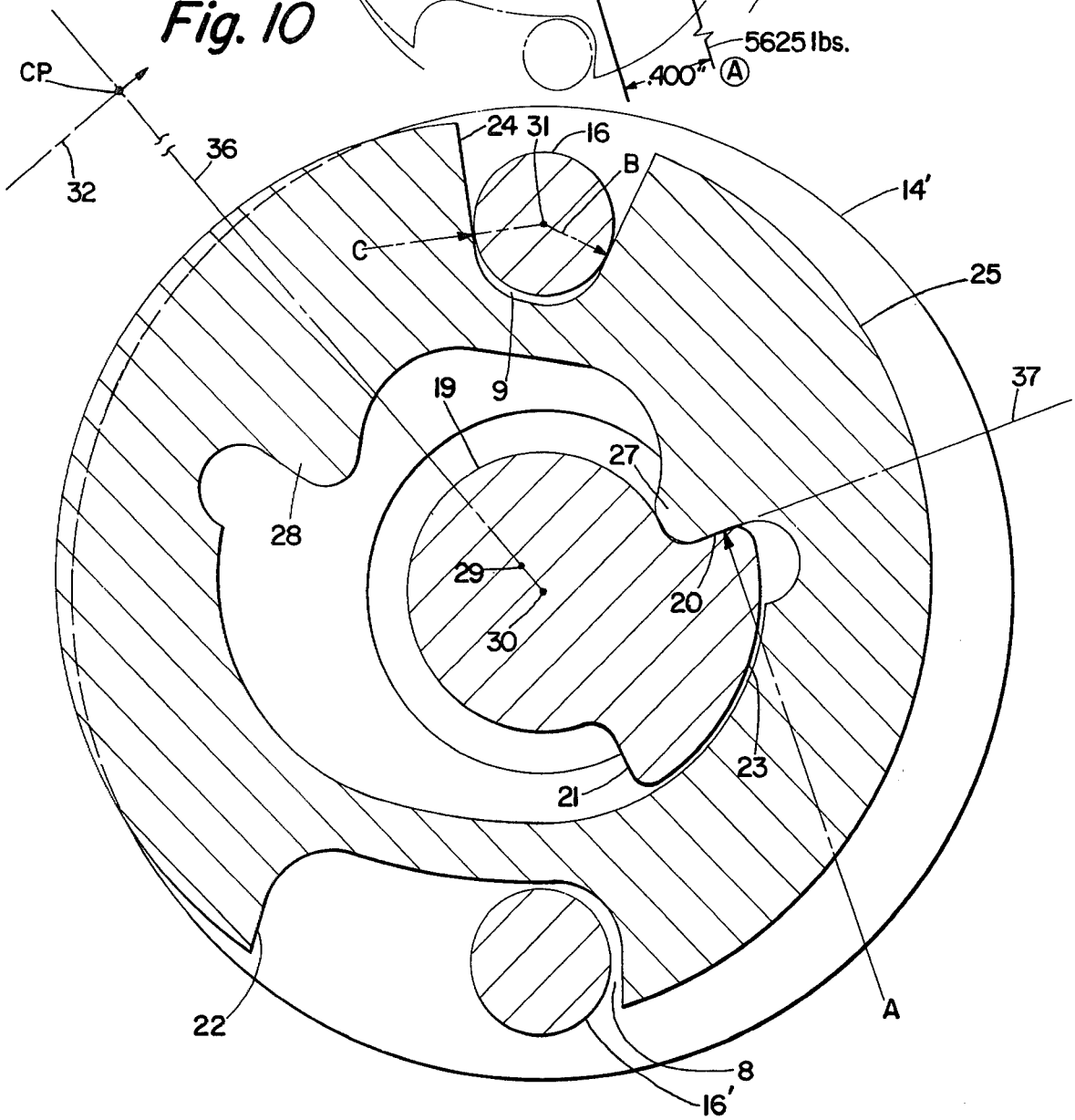
FIG. 9 is an enlarged sectional diagram showing the important relationship of a hammer member to its pivot pin and to the pivot pin of the other hammer member on impact.

As shown in FIG. 9, each hammer 25,25' is hollow and it has a substantially "U" shaped opening 24 with side walls that slope inwardly toward the hollow within the hammer member, and each hammer has an elongated slot 22 opposite the "U" shaped opening 24. The opening 24 is shown as a slot, but it is feasible to utilize an opening or hole in the hammer member 25, but it is important that the side walls of the opening taper toward each other so that the inclined walls both engage the pin 16 and establish a clearance 9 between the pin 16 and the hammer 25. The importance of clearance 9 will subsequently be fully explained. In two-hammer operation, pin 16 is the pivot for hammer 25 and pin 16' is the pivot for hammer 25', the elongated slot 22 accommodating the opposite pin and allowing for pivot motion of each hammer. FIG. 9 shows the rear hammer 25 at the moment of impact on anvil jaw 23 of shaft 19. It is important that space 8 be provided to prevent contact of hammer 25 against the pivot pin 16' of hammer 25', as will be more fully explained.

Figure 7:
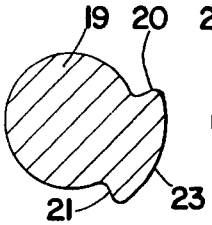
FIGS. 7 and 8 are sectional views through the two anvil portions of FIG. 6.
Figure 8:
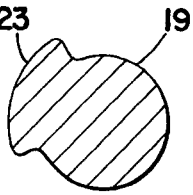

As shown in FIG. 7 anvil jaw 23 has a forward anvil surface 20 comprising part of the output shaft 19, and the jaw 23 has a reverse anvil surface 21 also comprising part of the output shaft. FIG. 8 shows the reverse anvil jaw in its relation to the forward anvil jaw.

Figure 2:
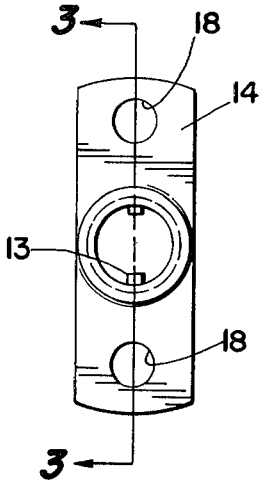
FIGS. 2 and 3 are face and sectional views, respectively, of the driver member.
Figure 3:
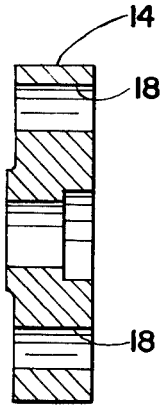
Figure 4:
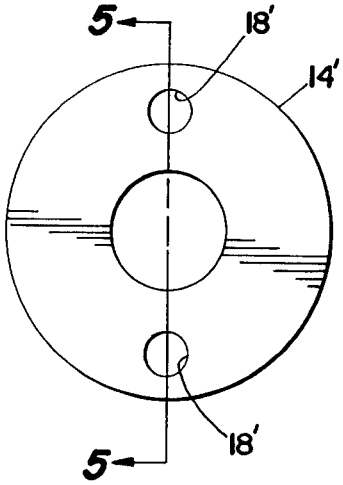
FIGS. 4 and 5 are face and sectional views, respectively, of the front end plate member.
Figure 5:
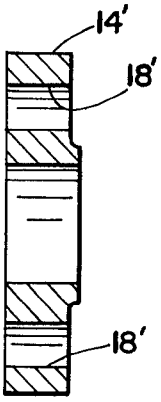
Figure 6:
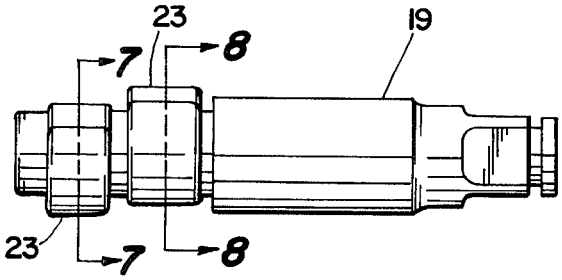
FIG. 6 is a side view of the output shaft for a two-hammer tool and its two anvils.

As shown in FIGS. 2 and 3 the driver member 14 has holes 18 therethrough to accommodate pins 16,16', and as shown in FIG. 2 it has parallel sides, whereas the front end plate 14' (shown in FIG. 4) is circular in shape. Thus the front end plate 14', when rotating, has considerably more inertia than does the driver member 14 when it is rotating. This relationship is important to establish, in a two-hammer tool, approximately equal inertia balance between the motor rotor, its output shaft 11 or driving connection means and the driver member 14, on the one hand, to, on the other hand, the inertia of said front end plate 14'. This relationship results in the two hammers 25 and 25' striking substantially equal blows on the output shaft 19. This substantially increases the lift of the tool by minimizing top stress on the anvils 23. It is to be understood that the blows are struck substantially at the same instant.

The operation of the mechanism is explained starting from the moment of impact which is shown in FIG. 9, with the forward impact jaw 20 of the carrier member means 15 in a hammer blow engagement with the forward anvil surface of the output shaft 19. The motor output shaft 11 is directly driving the carrier member means 15 in a clockwise direction. Immediately following the impact, the hammer member 25 tilts in a counterclockwise direction about pivot pin 16 until the jaws disengage. This tilting movement of the hammer member 25 is caused either by inertia forces during rebound of the hammer member 25 following impact or by the motor torque driving the hammer member against the anvil impact surface 20 which cams the hammer member counterclockwise.

The carrier member means 15 and hammer member 25 are now free from the anvil jaw 23 and accelerate in unison in a clockwise direction about the center axis of the anvil until cam engagement is about to commence. Continued forward rotation of the hammer member 25 causes a reverse impact jaw 28 on the hammer member 25 to ride up over the forward anvil impact surface 20 on the anvil jaw 23, which cams the hammer 25 back to its original, or engaged, position, where it is maintained by centrifugal force acting on the center of gravity of the hammer member 25.

Continued rotation of the carrier member means 15 and hammer 25 in unison brings the parts back to their original positions and another impact blow is delivered. During a blow the inertia of the rotating hammer member 25 acting on the anvil 23 acts to prevent disengagement of the hammer until the momentum of both the carrier member means 15 and hammer members has been expended.

An advantage of this tool lies in the fact that the total kinetic energy of the motor rotor from motor shaft 11, the carrier member means 15 and the hammer members 25 are used in each impact, since there can be no disengaging action until the momentum of the hammer members has been dissipated. The disengaging torque produced by the momentum of the motor rotor and carrier member means is countered by the engaging torque created by deceleration of the hammer members. When the momentum of the rotating parts has been dissipated, disengagement can occur under the influence of the motor torque, and the cycle begins again.

When a nut is loose the tool acts to run it down without impacting until sufficient resistance is encountered, at which point the tool automatically commences to impact. During run-down, due to centrifugal force and friction between the hammer and anvil jaws, good run-down torque is obtained from the motor directly through the carrier member means 15 to the hammer members 25, and thence directly to the tool output shaft 19.

In forward rotation the forward impact jaw 27 always leads the pivot point at pin 16 so that compressive stress is set up in the hammer member between the jaw and the pivot point during an impact blow. During reverse action the same effect is achieved in reverse direction.

During reverse, or loosening action of the tool, the hammer member 25 is in impacting position, similar to FIG. 2, but with reverse impact jaw 28 against reverse anvil surface 21. The impacting action is similar to the forward impacting action.

FIGS. 6 to 9 of U.S. Pat. No. 3,661,217 may be referred to for further detailed explanation of two-hammer operation.

It is believed to be worthwhile to explain the various forces acting on this impact mechanism at various stages of its operating cycle in order for the reader to appreciate the benefits provided by this mechanism over the prior art. Many of these forces are shown diagrammatically in FIG. 7 of U.S. Pat. No. 3,661,217, which shows a hammer member 25 of the two-hammer embodiment in impact position against the anvil jaw 23 and is the same as FIG. 9 of the present case.

Prior to impact, the hammer member 25 is rotating in a clockwise direction about the center line axis of the carrier member means 15, and the hammer member 25 is tilted about its tilt axis to offset its center of mass 29 to the left of the center line axis. Due to the unbalance of the hammer member 25, a centrifugal force is created acting along the dotted line 36 extending through the center line axis and the offset center of mass 29. This centrifugal force holds the hammer member 25 in engagement position so long as the carrier 15 rotates at a high speed.

When the hammer member 25 strikes the anvil jaw 23, it decelerates very rapidly causing inertia forces to act on the hammer member 25. The impact surfaces 20 and 27 are formed to impact along the radial plane indicated by the dotted line 37. The plane 37 is located to provide an impact force line A which extends normal to the plane 37 and is located a short distance to the right of the tilt axis 31 of pin 16. The force line A represents the direction of the impact forces delivered to the anvil. The force line A is located slightly outside of the center line tilt axis 31 of pin 16 in order for the motor torque to be able to cam the hammer member 25 to a disengaged position.

During the instant of impact, while the hammer member 25 is decelerating and delivering its impact energy to the anvil, inertia forces caused by the deceleration act to overcome the camming force and to hold the hammer member 25 against tilting counterclockwise to the disengaged position. This action is called "impact lock-up" and is necessary in order for the hammer to deliver its full blow energy to the anvil.

The resultant of these inertia forces at peak torque acts on a line 32, through the center of percussion CP, perpendicular to the line 36 in a clockwise direction, and is equal to $m \times r \times \alpha$, where m is the hammer mass, r is the distance of the center of gravity from the center of rotation 30, and $\alpha$ is the angular rate of deceleration. Due to its location, the resultant inertia force applies a clockwise torque on the hammer member 25 about its tilt axis 31 to overcome the camming force acting along the force line A. Thus, the hammer member 25 is prevented from moving during the instant of impact.

Normally, the hammer member 25 and carrier 15 rebound through a counterclockwise angle following impact due to the resilient nature of the mechanism much the same as a carpenter's hammer rebounds after a blow. The angle of travel of a rebounding hammer can be quite large, for example, as much as 120 degrees. During the rebounding travel, the motor is attempting to decelerate the hammer member 25 and this creates an inertia force acting through the center of percussion normal to the line 36 and opposite to the "impact lock-up" force. This force applies a counterclockwise torque on the hammer member 25 causing it to swing rapidly counterclockwise to its disengaged position. The previous discussion is described in considerable detail in U.S. Pat. No. 3,661,217, and this patent may be referred to for additional information, if necessary.

It is recognized that the hammer 25 probably does not have to extend completely around the anvil to obtain all of the advantages disclosed for this mechanism. However, it is believed that the hammer should extend at least 180 degrees around the anvil and the center of mass of the hammer should be closer to the axis of rotation than to the tilt axis of the hammer.

Figure 10:
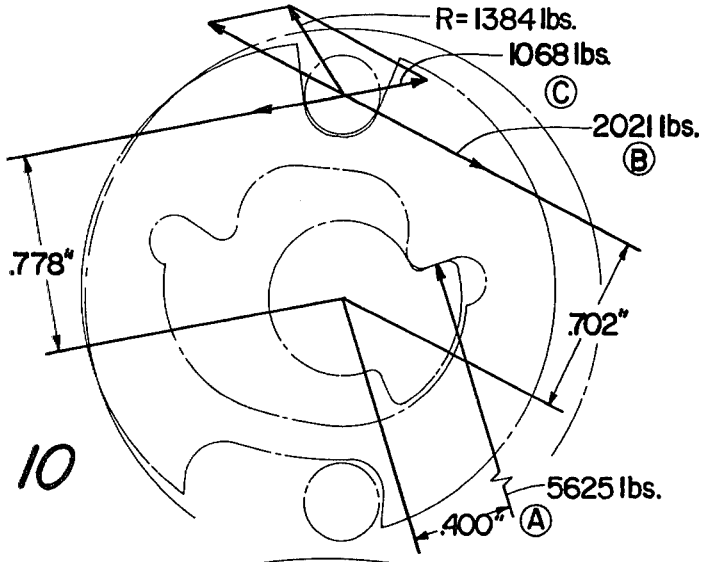
FIG. 10 shows a force diagram illustrating the relationships and directions of the forces involved at impact.

FIG. 10 shows a force diagram for one of the hammers during impact at an output torque level of 375 lbs./ft. Each hammer contributes one-half of the output torque or 2250 lbs./in. The contact point between the hammer and anvil impact faces is at a radius of 0.4"

from the center of rotation, resulting in an impact force of 5625 pounds per hammer (designated Ⓐ). This force results from the deceleration of the hammer and carrier means and driving rotor. Deceleration of the carrier means and rotor creates a force B between the pivot pin and the hammer which, when multiplied by the effective moment arm of 0.702", results in a counterclockwise moment acting on the pivot pin sufficient to decelerate the carrier means and the driving rotor at the same rate as the hammers are being decelerated. Since the inertia of the carrier means and rotor amount to about 63% of the total inertia, the value of this moment is $0.63 \times 2250$ or 1419 lbs./in. for each pin. The value of force Ⓑ is then $1419/0.702 = 2021$ pounds.

For the hammer member to be in equilibrium, the moment of the resultant of the effective forces must be equal and opposite to the moment of the resultant of the external forces and is numerically equal to the moment of inertia of the body times the rate of deceleration. The moment of the resultant of the externally applied forces Ⓐ and Ⓑ is a counterclockwise moment of $2250 - 1419 = 831$ lbs./in. on each hammer. Therefore, the moment of the resultant of the effective forces is a clockwise moment of 831 lbs./in. If the limit stop for the hammer pivot motion was anywhere on the carrier, then this resultant effective inertia moment would act to increase the pin force Ⓑ. But, by using the anvil as the limit stop, and using a V notch design pivot connection, this resultant clockwise moment acts at Ⓒ to actually reduce the resultant pin load.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What I claim is:

1. A rotary impact tool comprising, in combination, a housing, a motor having a rotor mounted in said housing, an output shaft mounted on said housing for rotation and including impact receiving anvil jaw means generally radially disposed on its periphery, carrier member means coaxially around said output shaft and mounted for rotation in respect to said output shaft, driving connecting means between said rotor and said carrier member means for rotating said carrier member means, hammer member means pivotally connected in said carrier member means for rotation therewith and for angular pivotal motion relative thereto about an axis offset from but parallel to the axis of rotation of said carrier member means, said hammer member means for clockwise impact operation having clockwise impact delivering jaw means on its inside surface means located between 0° and 90° clockwise from its pivot connection to the carrier member means, said impact jaw means being movable into and out of the path of said impact receiving anvil jaw means to deliver impact blow(s) thereto, cam means for effecting the angular pivot movement of said impact delivering jaw means into the path of said anvil jaw means in a clockwise direction relative to said carrier member means, centrifugal force created by the proportions, mass and mass center location of said hammer member means holding said impact delivering jaw means in the path of said anvil jaw means until the delivery of said impact blows thereto, said impact delivering jaw means being so shaped and positioned that when in forceful contact with said anvil jaw means a counterclockwise pivot torque is created acting on said hammer means tending to pivot it out of engagement with said anvil jaw means, inertia forces created by the proportions, mass and mass center location of said hammer means preventing said counterclockwise pivot motion of said hammer means until the conclusion of the impact blow;

said carrier member means comprising a front plate and a rear drive member, each having at least one hole therein, offset axially from said output shaft, and longitudinal pin means extending into said at least one hole in said front plate and rear drive member connecting said plate and member together for said carrier member means rotation and providing pivot means for said hammer member means.

2. A rotary impact tool as set forth in claim 1, further characterized by hammer member means having therein at least one opening with side walls inclined toward each other in the direction of the output shaft to accommodate said pin means in contact against said side walls for pivotal motion about said pin means, the said pin means being free from contact with said hammer member means other than at said inclined side walls.

3. A rotary impact tool as set forth in claim 2, further characterized by said pin means comprising two pins and by said hammer member means comprising two hammers each having an opening with side walls inclined toward each other in the direction of the output shaft to accommodate one of said pins for pivotal motion about said pin.

4. A rotary impact tool as set forth in claim 3, further characterized by said output shaft providing limit stop means for the pivotal motion of said hammer means.

5. A rotary impact tool as set forth in claim 1, further characterized by the inertia of said front end plate being approximately equal to the inertia of said rotor, said driving connection means and said driver member together.

6. A rotary impact tool as set forth in claim 5, further characterized by said hammer means comprising two hammers each having an opening with side walls inclined toward each other in the direction of the output shaft to accommodate one of said pins for pivotal motion about said pin, and each hammer being free from contact with said other pin, said openings being so shaped and dimensioned that the said pin when in engagement with the side walls of said opening for pivotal motion is free of contact with other portions of said pivoted hammer.

7. A rotary impact tool as set forth in claim 6, further characterized by said output shaft providing limit stop means for the pivotal motion of said hammer means.

8. A rotary impact tool as set forth in claim 1, further characterized by said output shaft providing stop means for the pivotal motion of said hammer means.

9. A rotary impact tool comprising, in combination, a housing, a motor having a rotor mounted in said housing, an output shaft mounted on said housing for rotation and including impact receiving anvil jaw means generally radially disposed on its periphery, carrier member means including pin means parallel to and offset from the axis of said output shaft and mounted for rotation in respect to said output shaft, driving connection means between said rotor and said carrier member means for rotating said carrier member means, hammer member means having opening means therein to accommodate said pin means for pivotal connection to said carrier member means for rotation therewith and for angular pivotal motion relative thereto about an axis offset from but parallel to the axis of rotation of said carrier member means, said opening means having a bottom and having side walls inclined toward each other in the direction of said output shaft and being so shaped and dimensioned in respect to said pin means that the said pin means when in engagement with the inclined walls of said opening means provide space between the said pin and the bottom of said opening means.

10. A rotary impact tool as set forth in claim 9, further characterized by said pin means comprising two pins and by said hammer member means comprising two hammers each having said opening means to accommodate one of said pin means, and each hammer being free from contact with said other pin.

11. A rotary impact tool as set forth in claim 10, further characterized by said output shaft including two stop means against which said two hammers stop, each hammer stopping its pivotal motion against its respective stop without engaging the pivot pin of the other hammer.

12. A rotary impact tool as set forth in claim 10, further characterized by said carrier member means including a driver member and a front end plate, each having holes therethrough to accommodate said pin means, and by the inertia of said front end plate being approximately equal to the inertia of said rotor, said driving connection means and said driving member together.

13. A rotary impact tool as set forth in claim 9, further characterized by limit stop means for the pivotal motion of the hammer means relative to said carrier means comprising a portion of said output shaft which engages a portion of said hammer means to limit the pivotal motion of said hammer means.

* * * * *